United States Patent [19]

Kreiling et al.

[11] Patent Number: 4,857,416

[45] Date of Patent: Aug. 15, 1989

[54] INFRA-RED EMITTING ELECTROLUMINESCENT LAMP STRUCTURES

[75] Inventors: William H. Kreiling, Lebanon, N.H.; William A. Tower, South Royalton, Vt.

[73] Assignee: Loctite Luminescent Systems, Inc., Lebanon, Mass.

[21] Appl. No.: 139,966

[22] Filed: Dec. 31, 1987

[51] Int. Cl.[4] ..... H05B 33/02; H05B 33/22

[52] U.S. Cl. ..... 428/690; 428/917; 313/503

[58] Field of Search ..... 313/503, 504, 507, 512; 428/690, 691, 917

[56] References Cited

U.S. PATENT DOCUMENTS

| | | | |
|---|---|---|---|
| 3,310,703 | 3/1967 | Brooks | 313/506 |
| 3,430,088 | 2/1969 | Beswick | 313/512 |
| 3,711,719 | 1/1973 | Szepesi | 313/507 X |
| 4,035,686 | 7/1977 | Fleming | 313/504 X |
| 4,666,793 | 5/1987 | Hirate | 313/503 X |
| 4,672,264 | 6/1987 | Higton | 313/503 |
| 4,677,010 | 6/1987 | Selwyn | 428/690 X |

*Primary Examiner*—Nancy A. B. Swisher

*Attorney, Agent, or Firm*—Robert F. O'Connell

[57] ABSTRACT

A structure for providing electromagnetic wave energy primarily in the near infra-red region of the spectrum and having an electroluminescent lamp element which includes a red fluorescent dye material for emitting energy in both the visible and the near infra-red regions of the spectrum, and at least one layer of optical filter material having selected color filter characteristics for transmitting electromagnetic wave energy therefrom in a manner such that the amount of energy transmitted in the near infra-red region is substantially increased and the amount of energy transmitted in the visible region is substantially decreased.

16 Claims, 3 Drawing Sheets

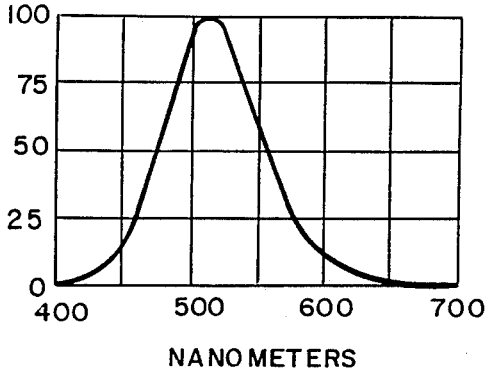
FIG. 1
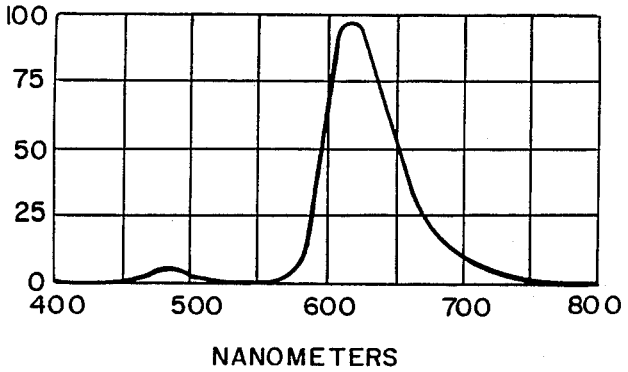
FIG. 3
FIG. 2
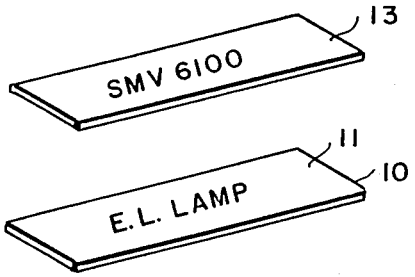
FIG. 13
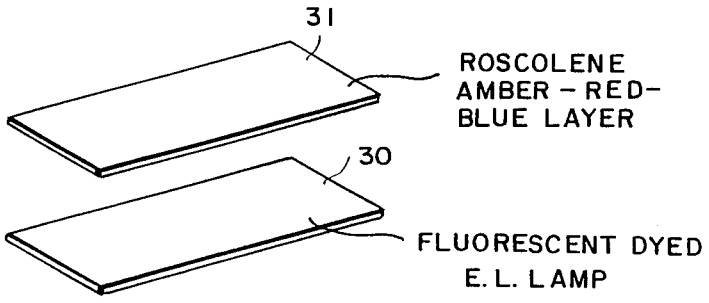

INFRA-RED EMITTING ELECTROLUMINESCENT LAMP STRUCTURES

INTRODUCTION

This invention generally relates to electroluminescent lamps and, more particularly, to the design of such lamps for providing enhanced light emission in the near infra-red portion of the spectrum and for minimizing light emission in the visible portion of the spectrum.

BACKGROUND OF THE INVENTION

It is desirable in some applications to utilize infra-red emitting electroluminescent (EL) lamp structures for providing illumination of an area in the near infra-red (NIR) region of the spectrum, for example, while minimizing illumination in the visible region of the spectrum. For example, such area illumination can be used on aircraft as formation lights for night vision recognition wherein the lights are designed to avoid as well as possible illumination in the visible portion of the spectrum while providing IR illumination which can be seen by the use of suitable IR sensitive or IR responsive means, such as IR sensors or specially designed IR responsive goggles.

Although an exact line of demarcation is not clearly defined, as used herein, the near infra-red region is generally referred to as lying above about 700 nm. with energy below 700 nm. being generally referred to as lying within the visible range.

Attempts have been made to provide such illumination using known IR emission sources, such as are available using light emitting diodes designed to emit infra-red waves. However, such devices act as point light sources, rather than as area light sources, and it is difficult, for example, for persons responding to such devices to obtain a sufficiently good perception of depth from a single, or even a discretely positioned group, of such point sources. Accordingly, the use of such point source IR emitters has prove generally unsatisfactory in such applications.

Generally the most effective area source of illumination for such applications has been found to be electroluminescent lamp sources which can be designed to provide a relatively uniform illumination over a relatively large spatial region and which can be formed in a variety of shapes and configurations for applications on aircraft, for example, or at other locations.

However, the major spectral energy distribution of electromagnetic wave energy obtained from electroluminescent lamp sources available at the present time is generally concentrated in the visible portion of the spectrum, quite often in the 450–650 nanometer (nm.) range of wavelengths, such as standard white, blue-white, pink-white, aviation green, blue-green, yellow-orange or yellow-green EL lamps, which may have some, but very low, residual levels of emitting energy beyond such range, i.e., above about 650 nm. (normally less than 5% of the total energy emitted being within the range from about 650 nm. to about 1000 nm., or so). Certain EL lamps have been designed to provide what has been termed aviation red illumination and, while such lamps emit energy above 600–650 nm., a reasonable amount of energy below the 600–650 nm. range is also present therein.

Examples of such devices and their spectral energy distribution and chromaticity characteristics are shown, for example, in "Design Guide to Electroluminescent Lighting" (3rd Printing, 1986), published by Loctite Luminescent Systems of Lebanon, N.H. and available from such company. Thus, in order to provide useful emissions within the actuation levels of IR night vision sensors, it is desirable to increase the energy emitted above about 650 nm., or so, relative to the energy emitted below about 650 nm., or so, by as much as an order of magnitude, if possible.

BRIEF SUMMARY OF THE INVENTION

In accordance with the invention, an electroluminescent lamp structure has been devised to shift the peak range of wavelength emissions from the normal peak range found in such devices to a higher range so as to increase the relative portion of the overall emission which lies above about 650 nm. and preferably above 700 nm., while minimizing the portion thereof below about 650 nm. and preferably below about 700 nm. Such operation is achieved in an exemplary structure by using a layer of material comprising a red fluorescent dye in a polymer binder over the emitting surface of an EL lamp structure much as is done when forming an EL lamp to provide an aviation red color. In applications in which it is desirable to enhance the energy in the near IR range and to substantially reduce or effectively prevent emission below the near IR range of the spectrum, such a structure further includes a filter means having selected optical filter characteristics positioned over the fluorescent dyed film layer. In an overall structure using such fluorescent dyed layer and such selected optical filter means, enhancement of IR emission is achieved while emission in the visible portion of the spectrum is effectively minimized.

DESCRIPTION OF THE INVENTION

The invention can be described in more detail with the help of the accompanying drawings wherein FIG. 1 is a graph showing the spectral emission distribution characteristics of a previously available electroluminescent lamp structure for providing aviation green emission;

FIG. 2 shows an exploded view of a previously available electroluminescent lamp structure for providing aviation red emission;

FIG. 3 shows a graph of the spectral emission distribution characteristics for the structure of FIG..2;

FIG. 13 shows an exploded view of a further alternative embodiment of the invention.

As can be seen in FIG. 1, the emission spectrum of a typical aviation green EL lamp structure, such as those currently available to the art, generally lies within a range from about 450 nm. to between about 600 nm. to 650 nm. with a peak emission generally between 510–530 nm., e.g., at or about 516 nm. In such spectral energy distribution curves as shown in FIG. 1 and in other comparable figures discussed below, the spectral energy level is shown as normalized to the maximum level thereof in a manner well-known to the art. Such a structure may be an exemplary aviation green (AVG) lamp structure as manufactured and sold by Loctite-Luminescent Systems, Inc. of Lebanon, N.H. Only a relatively small portion of the total emission spectrum lies above 600 nm., i.e., in the near infra-red region, and such portion represents generally only a few percent of the total emitted energy. The amount of near-IR energy emission is substantially swamped by the visible energy emitted and detection of any IR energy, even should emission of the visible energy be somehow reduced, would be ineffective for applications where effective IR energy detection is desired and visible emission detection is not desired, as for night vision identification of aircraft, for example.

The structure shown in FIG. 2 provides aviation red emission where spectral energy is generally above about 600 nm. In such a structure an EL lamp element 10 has an outer surface 11 and a layer of a red fluorescent dyed polymer binder material 13, e.g., a polyvinyl chloride film, is adhered to the surface of lamp element 10 using any suitable adhesive material known to the art. A particular fluorescent film material which has been found useful for such purpose is available under the Model Designation SMV6100 as sold by SMV Technology Products of Wilmington, Del.

A typical exemplary spectral energy distribution for the aviation red structure shown in FIG. 2 is depicted in FIG. 3 in which it can be seen that the emitted energy has shifted from that of FIG. 1 so as to occur over a general range from about 575–600 nm. to about 700–725 nm., with a peak emission between 600–625 nm. While the near IR portion of the emitted energy is enhanced by a reasonable amount relative to that emitted in the visible region, e.g., below about 700 nm., a reasonable portion thereof is still provided in the visible region and the usefulness of such a device in IR detection applications is limited.

Figure 4:
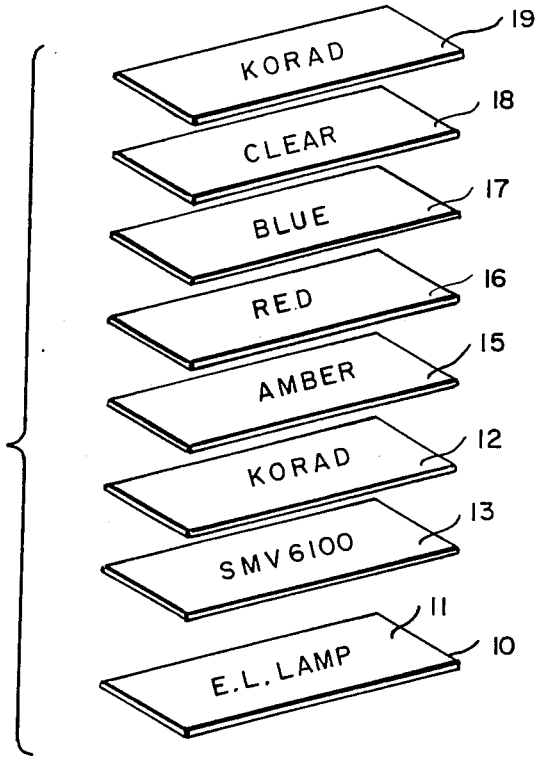
FIG. 4 shows an exploded view of an embodiment of an overall electroluminescent lamp structure of the invention for providing enhanced emission in the near infra-red region of the spectrum and minimized emissions in visible regions thereof.

The structure of FIG. 2 can be further modified in accordance with the invention to provide an overall structure in which emission in the visible range, generally below 700 nm., can be minimized, or effectively eliminated, while the amount of near IR emissions relative thereto is considerably increased with the peak emission even further shifted into the IR region. As can be seen in FIG. 4, such a structure, which uses the same basic structure as that shown in FIG. 2, further includes successive layers of color filter materials which comprise, in the particular embodiment depicted, a layer 15 of an optical amber filter material, a layer 16 of an optical red filter material, and a layer 17 of an optical blue filter material.

In the exemplary structure depicted, a suitably adhered layer 12 of a polymeric film material can be used between the layers 13 and 15, for example. One such layer may be a well known acrylic film material, for example, available under the trade designation "KORAD" (R) from Korad, Inc., of Newark, N.J. Alternatively, the layer 12 can be omitted and the layer 15 can be suitably adhered directly to layer 13.

In the embodiment shown, an additional layer 18 of clear optical material, and a final outer layer 19 of acrylic film (e.g., Korad) complete the overall structure as shown. It should be understood that a Korad layer 19 is used primarily in producing formation lights, while in other applications the Korad layer need not be used. In such latter cases the clear layer 18 can also be eliminated since it is only used to permit the Korad layer to be effectively bonded to the top filter layer.

Layer 15 may be an amber filter such as is available under the designation Roscolene-817-Amber, layer 16 may be a red filter such as is available under the designation Roscolene-837-Red, layer 17 may be a blue filter such as is available under the designation Roscolene-861-Blue. If needed, clear layer 18 may be a material available under the designation Roscolene-801-Clear, all such materials, or other similar usable materials, being made for sale by Rosco Corporation, of Port Chester, N.Y., for example.

Figure 5:
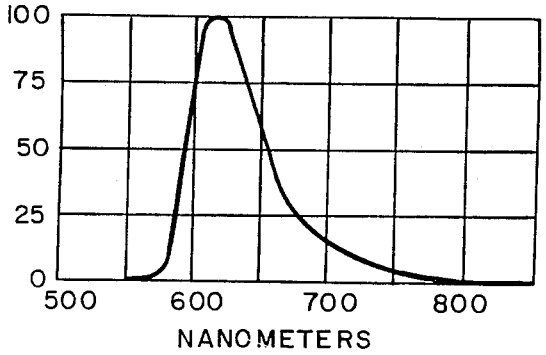
FIGS. 5–7 show graphs of the spectral emission distribution characteristics of the structure of FIG. 4 using various combinations of color filter characteristics therein.
Figure 6:
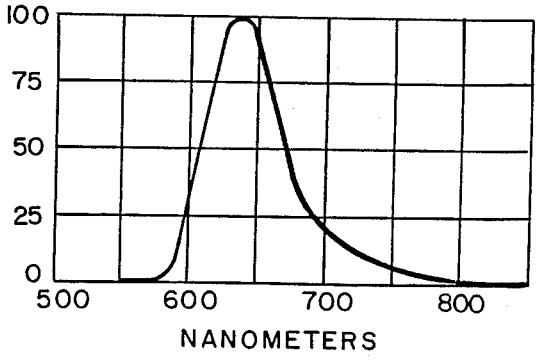
Figure 7:
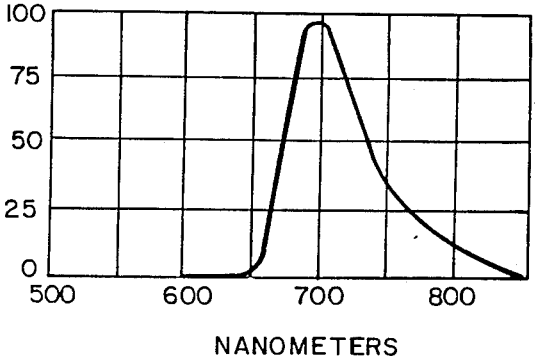

The use of the color filter layers 15, 16 and 17 tends to substantially reduce, or effectively eliminate, the emission of light in the visible part of the spectrum while also permitting the emission thereof in the near IR regions of the spectrum, so that the relative emission of near IR energy to visible energy is considerably enhanced. In typical cases, for example, FIGS. 5 and 6 show the effects of successively adding amber and red layers 15 and 16, respectively, while FIG. 7 shows the emission spectrum distribution when a blue layer is added to provide all three color filter layers in the overall structure of FIG. 4. As can be particularly seen in FIG. 7, when using all three color filter layers, the energy emitted lies substantially completely above 650 nm. with a peak at about 700 nm., substantially no energy being emitted below 650 nm.. so that the relative amount of near IR emission to visible emission is considerably enhanced.

Figure 8:
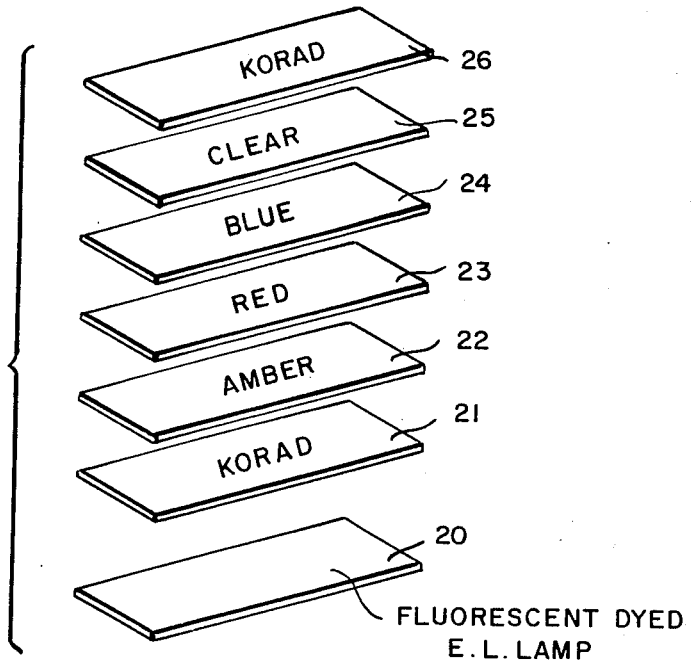
FIG. 8 shows an exploded view of an alternative embodiment of the invention for providing enhanced IR spectral emission distribution characteristics of an EL lamp structure having minimized visible emission.

FIG. 8 shows an alternative embodiment of an overall structure of the invention wherein a basic aviation red lamp element using a red fluorescent dyed layer (such as shown, for example, in FIG. 2) is replaced by an assembled lamp structure 20 in which the electroluminescent material itself includes a suitable red fluorescent dye material which is substantially uniformly distributed therein. Such dye material can be distributed throughout the EL material using well-known paint mixing or dye dispersion techniques. One such dye is a fluorescent red dye material made and sold under the designation Nile Red 52445 (CAS Registry No. 7385-67-3) by Eastman Kodak Company of Rochester, N.Y.

Figure 9:
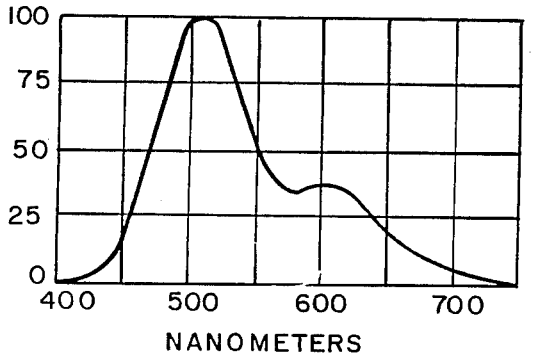
FIGS. 9–12 show graphs of spectral emission distribution characteristics for the embodiment shown in FIG. 8 using various combinations of color filter layers therein.

FIG. 9 shows a graph of the spectral emission of the fluorescent dyed lamp element structure of FIG. 8, using a similar Korad layer 21 positioned over lamp structure 20, as in FIG. 1. As seen therein emission occurs from above about 425 nm. with a peak at about 500 nm. and a sub-peak at about 600 nm.

Figure 10:
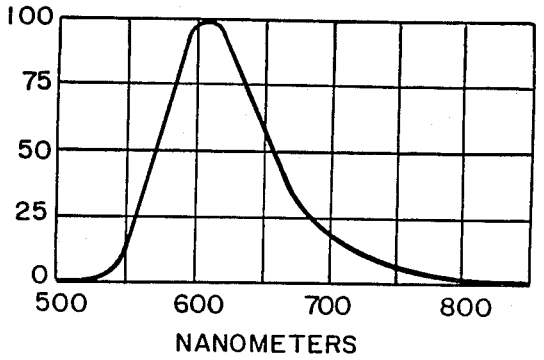
Figure 11:
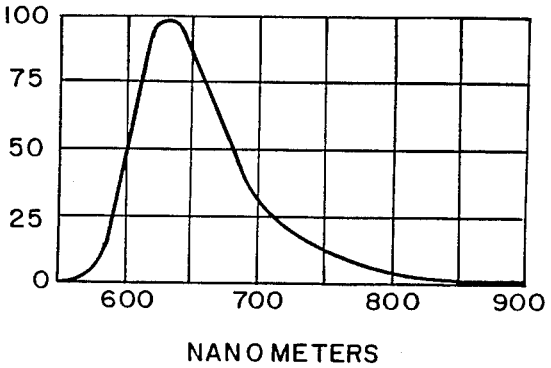
Figure 12:
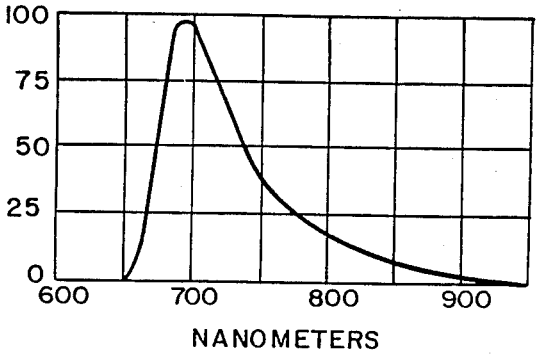

FIGS. 10, 11, and 12 show how the spectral emission distribution characteristics change as each successive optical filter layer 22, 23, and 24 is positioned over the fluorescent dyed lamp structure of FIG. 9, together with a clear layer 25 and an outer Korad layer 26, in substantially the same manner as discussed with reference to FIG. 4. The same optical filter materials can be used as discussed with reference to the latter figure.

Again FIGS. 10–12 show how the amount of emission in the near IR region of the spectrum increases relative to emission in the visible region upon the addition of each successive optical film layer 22, 23 and 24, emission in the visible region being effectively eliminated in the overall structure of FIG. 8 in a manner which is substantially similar to that shown in FIG. 7. Again as discussed with reference to FIG. 4, in some applications layers 25 and 26 can be eliminated, if desired.

In the above embodiments, it should be realized that the order of sequence of the filter layers is not critical and such layers need not be used in the specific order depicted in FIGS. 4 and 8 but can be ordered in any sequence with little or no effect on the spatial emission distribution characteristics of the overall structure. Moreover, other color filter combinations, apart from the amber-red-blue combination depicted, may be selected for use so long as their use provides an enhancement of near IR emission relative to visible emission as discussed above, i.e., near IR emission is increased while visible emission is substantially reduced.

While the filter elements are depicted in the embodiments of FIGS. 4 and 8 as effectively forming separate layers suitably adhered to each other, appropriate filter characteristics can also be effectively obtained by forming such filters as a single layer. Thus film layers 15, 16 and 17 or film layers 22, 23 and 24 can be melted, or fused, together so that each separate film layer loses its identity and the overall combination of fused film layers effectively form a single layer as shown in FIG. 13. In such figure an EL lamp element 30 (which may be of the type shown by layers 10, 12 and 13 of FIG. 4 or by layers 20 and 21 of FIG. 8) has adhered thereto an exemplary single, fused amber-red-blue layer 31. A clear layer/Korad layer combination may or may not be adhered to the structure of FIG. 13 as discussed above.

While the above specific embodiments are shown to provide desired overall structures, modifications thereof may occur to those in the art within the spirit and scope of the invention. Hence the invention is not to be limited to the specific embodiments described above except as defined by the appended claims.

What is claimed is:

1. A structure for providing electromagnetic wave energy primarily in the near infra-red region of the spectrum, said structure comprising an electroluminescent lamp element including a red fluorescent dye material for emitting electromagnetic wave energy in the visible and in the near infra-red regions of the spectrum from a surface thereof; and at least one layer of optical filter material having selected color filter characteristics positioned over said emitting surface of said electroluminescent lamp element for transmitting electromagnetic wave energy therefrom in a manner such that the amount of energy transmitted in the near infra-red region of the spectrum is substantially increased and the amount of energy transmitted in the visible region of the spectrum is substantially decreased.

2. A structure in accordance with claim 1 wherein said at least one layer of optical filter material comprises a plurality of optical filter layers each of a different selected color.

3. A structure in accordance with claim 2 wherein said plurality of optical color filter layers comprises three layers thereof.

4. A structure in accordance with claim 3 wherein said three optical filter layers comprise a first color filter film layer of a first selected color;

a second color filter film layer of a second selected color; and a third color filter film layer of a third selected color.

5. A structure in accordance with claim 4 wherein said first, second and third color filter film layers are positioned over said emitting surface in any selected order.

6. A structure in accordance with claim 4 wherein said first selected color is amber, said second selected color is red, and said third selected color is blue.

7. A structure in accordance with claim 1 wherein said electroluminescent lamp element comprises a layer of electroluminescent material; and a layer of red fluorescent dyed film material bonded to said layer of electroluminescent material.

8. A structure in accordance with claim 7 wherein said layer of red fluorescent film material comprises a red fluorescent dye in a polymer binder film.

9. A structure in accordance with claim 8 wherein said polymer binder film is a polyvinyl chloride film.

10. A structure in accordance with claim 1 wherein said electroluminescent lamp element comprises a layer of electroluminescent material having a red fluorescent dye distributed substantially uniformly in said layer of electroluminescent material.

11. A structure in accordance with claim 10 wherein said red fluorescent dye is a Nile Red fluorescent dye.

12. A structure in accordance with claim 7 and further including a layer of an acrylic material positioned between said layer of red fluorescent dyed film material and said at least one layer of optical film material.

13. A structure in accordance with claim 1 and further including a layer of clear optical material positioned over said at least one layer of optical filter material and a layer of acrylic material positioned over said layer of clear optical material.

14. A structure in accordance with claim 1 wherein said at least one layer of optical filter material comprises a single layer of optical film material formed by fusing together a plurality of optical filter films of different optical color characteristics into a single layer thereof.

15. A structure in accordance with claim 14 wherein said plurality of optical filter films comprise three films each having a different optical color characteristic.

16. A structure in accordance with claim 15 wherein said three different optical color characteristics are amber, red and blue.

* * * * *

UNITED STATES PATENT AND TRADEMARK OFFICE
Certificate

Patent No. 4,857,416

Patented: Aug. 15, 1989

On petition requesting issuance of a certificate for correction of inventorship pursuant to 35 U.S.C. § 256, it has been found that the above identified patent, through error and without any deceptive intent, improperly sets forth the inventorship. Accordingly, it is hereby certified that the correct inventorship of this patent is:

William H. Kreiling, William A. Tower and Norman T. Lorrey.

Signed and sealed this Thirteenth Day of November, 1990

ELLIS P. ROBINSON,

*SPE*
*Art Unit 158*